US010702049B2

(12) United States Patent
Tsai

(10) Patent No.: US 10,702,049 B2
(45) Date of Patent: Jul. 7, 2020

(54) BUCKLE BELT ASSEMBLY

(71) Applicant: Hai Pin Tsai, Hong Kong (CN)

(72) Inventor: Hai Pin Tsai, Hong Kong (CN)

( * ) Notice: Subject to any disclaimer, the term of this patent is extended or adjusted under 35 U.S.C. 154(b) by 102 days.

(21) Appl. No.: 16/102,746

(22) Filed: Aug. 14, 2018

(65) Prior Publication Data

US 2020/0054118 A1 Feb. 20, 2020

(51) Int. Cl.

| | |
|---|---|
| ***A45F 5/02*** | (2006.01) |
| ***A44B 11/26*** | (2006.01) |
| *A44B 11/00* | (2006.01) |
| *A44B 11/22* | (2006.01) |

(52) U.S. Cl.

CPC ..... *A45F 5/021* (2013.01); *A44B 11/266* (2013.01); *A44B 11/006* (2013.01); *A44B 11/22* (2013.01)

(58) Field of Classification Search

CPC ..... A45F 5/021; A44B 11/266; A44B 11/006; A44B 11/22; Y10T 24/4736; Y10T 24/4745; Y10T 24/4755; Y10T 24/44085; Y10T 24/44094; Y10T 24/44128

USPC ..... 24/614, 615, 265 BC, 265 EC, 163 R, 24/186, 187, 198

See application file for complete search history.

(56) References Cited

U.S. PATENT DOCUMENTS

| | | | | |
|---|---|---|---|---|
| 5,338,224 | A * | 8/1994 | Blanke | H01R 9/2683 24/17 AP |
| D421,562 | S * | 3/2000 | Persson | D8/341 |
| 2003/0233739 | A1* | 12/2003 | Coffey | A45C 13/20 24/302 |
| 2005/0198789 | A1* | 9/2005 | Wang | A44B 19/262 24/429 |
| 2006/0032877 | A1* | 2/2006 | Obolo | A45F 5/02 224/269 |
| 2006/0288546 | A1* | 12/2006 | Wu | A44B 11/006 24/615 |
| 2007/0051842 | A1* | 3/2007 | Pryor | A45C 11/182 242/378.3 |
| 2008/0042000 | A1* | 2/2008 | Horton | A01K 27/004 242/382 |
| 2010/0219312 | A1* | 9/2010 | Johnson | A45F 5/02 248/231.81 |

* cited by examiner

*Primary Examiner* — Robert Sandy
*Assistant Examiner* — Rowland Do

(57) ABSTRACT

A buckle belt assembly includes a main body and a buckle belt. The buckle belt includes a first body and a second body sleeved on the first body. The second body includes a supporting portion, a second movable portion, and a band extending from a bottom of the supporting portion. One end of the second movable portion is connected to the supporting portion, and the other end of the second movable portion is movable relative to the supporting portion. The second movable portion includes a pair of side walls and a pair of fixing walls. The band is configured to hang hanging objects, the band is configured with a fixing hole, and the side walls are pressed to abut the fixing wall to the fixing hole or to detach the fixing wall from the fixing hole, thereby opening or closing the band.

20 Claims, 9 Drawing Sheets

BUCKLE BELT ASSEMBLY

FIELD OF THE INVENTION

The present disclosure relates to pendant and accessory field, and more particularly to a buckle belt assembly configured to fasten a key, a mobile phone, or a certification card.

BACKGROUND OF THE INVENTION

The conventional buckle belt assembly may include an outer casing, a restoring device configured within an inner cavity of the outer casing, a flexible cable, and a buckle belt. The conventional buckle belt assembly is configured to hang the portable objects, such as keyrings, working cards, and access cards. The buckle belt may be pulled away from the outer casing when the portable objects are in use, and may automatically be restored by the restoring device when the portable objects are not in use. The conventional buckle belt assembly is convenient for storage and is popular among enterprise employees and home users. However, the conventional buckle belt assembly may have the following problems.

(1) The buckle belt of the buckle belt assembly is directly pulled, which is not an ideal design. As the number of uses increases, the buckle belt may be worn, causing the hanging objects to be unstable and easily to be lost.

(2) The conventional buckle belt assembly has a limited load-carrying capability. The restoring device and the flexible cable may be deformed and failed when the load is too great. When the buckle belt is automatically restored by the restoring device, the buckle belt and the outer casing are not able to be accurately positioned and accommodated, which may cause the buckle belt to be skewed relative to the outer casing, and may affect the use and aesthetics of the buckle belt assembly.

SUMMARY OF THE INVENTION

The present disclosure provides a buckle belt assembly which may simply be operated, and may easily be opened and closed. The hanging objects may not detach from the buckle belt when the hanging objects are not in use. As such, load-carrying capability of the buckle belt assembly may be improved, and the buckle belt may be automatically and accurately positioned with the outer shell of the buckle belt assembly when the cable is restored.

In one aspect, the present disclosure relates to a buckle belt assembly, including: a main body; and a buckle belt, including a first body and a second body being sleeved on the first body; wherein the second body further includes a supporting portion, a second movable portion, and a band being extending from a bottom of the supporting portion, one end of the second movable portion connects to the supporting portion, and the other end of the second movable portion is movable relative to the supporting portion; the second movable portion further includes a pair of side walls and a pair of fixing walls, the band is configured with a fixing hole, and the fixing walls engage with the fixing hole or detached from the fixing hole when the side walls are pressed.

Each of the side walls includes a first gap with respect to the supporting portion, each of the fixing walls includes a second gap with respect to the supporting portion, and the first gap communicates with the second gap.

The second body includes a hook and a fixing block, and the fixing block is perpendicular to the hook; and the first body further includes a hooking hole configured to be engaged with the hook to fix the first body to the second body, and the fixing block is configured to increase a fixing force between the first body and the second body.

The buckle belt includes an insertion end and a first movable portion, the buckle belt is configured to be fixed to or detached from the main body when the first movable portion is moved, the insertion end and the first movable portion are configured on the first body, an arc-shaped gap is connected between the first movable portion and the first body, and the first body further includes a positioning block.

The main body includes: an upper shell, a lower shell, an accommodating cavity being formed by fastening the upper shell with the lower shell, a restoring device being configured within the accommodating cavity, a cable being winded on the restoring device, wherein one end of the cable is fixed to the restoring device, and the other end of the cable is fixed to the buckle belt; wherein the restoring device includes a shaft wheel and a winder being configured in the shaft wheel, the cable is wound around the shaft wheel, a receiving groove is formed by simultaneously extending the upper shell and the lower shell outwardly, and the receiving groove communicates with the accommodating cavity; when the buckle belt is manually pulled to unfold the cable, the buckle belt detaches from the main body; when a pulling force is removed, the restoring device is configured to restore the cable, the buckle belt approaches the main body, and the insertion end automatically inserts into the receiving groove.

The receiving groove is recessed inwardly to form a first positioning slot, when the insertion end is completely inserted into the receiving groove, the positioning block is engaged with the first positioning slot to fix the buckle belt to the main body.

The first movable portion is manually driven to disengage the positioning block from the first positioning slot, the buckle belt is manually pulled to separate the buckle belt from the main body, and the restoring device is configured to unfold the cable.

The buckle belt assembly further includes: a first holding portion being sleeved on the main body, and a second holding portion being arc-shaped and being protruding from the first holding portion; the first holding portion includes a pressing hook being movable relative to the second holding portion, and one end of the pressing hook is configured to abut to or detach from the second holding portion when the pressing hook is pressed.

The lower shell includes a flexible fixing sheet being configured to fix the buckle belt assembly externally, and an end surface of the upper shell and an end surface of the lower shell are configured to be a flat surface, an oblique concave surface, or a sloped surface.

The main body includes a first connecting portion, a second connecting portion, and a hanging rope; the insertion end is configured to be inserted into the first connecting portion, the hanging rope is configured to penetrate through the first connecting portion, and the second connecting portion is configured to connect two ends of the hanging rope.

In view of the above, the present disclosure relates to the buckle belt assembly, including the main body and the buckle belt. The buckle belt includes the first body and the second body being sleeved on the first body. The second body further includes the supporting portion, the second movable portion, the band extending from the bottom of the supporting portion. One end of the second movable portion is fixed to the supporting portion, and the other end of the second movable portion is movable relative to the supporting end. The second portion includes a pair of the side walls and a pair of the fixing walls. The band may be a flexible and bendable plastic element. The band is configured to hang the hanging objects. The band is configured with the fixing hole. The fixing walls are configured to fix or to detach from the fixing hole when the side walls are pressed, so as to open or close the band. As such, the buckle belt assembly may simply be operated, and may easily be opened and closed, and the hanging objects may not detach from the buckle belt when the side walls are not pressed.

DETAILED DESCRIPTION OF PREFERRED EMBODIMENTS

Figure 1:
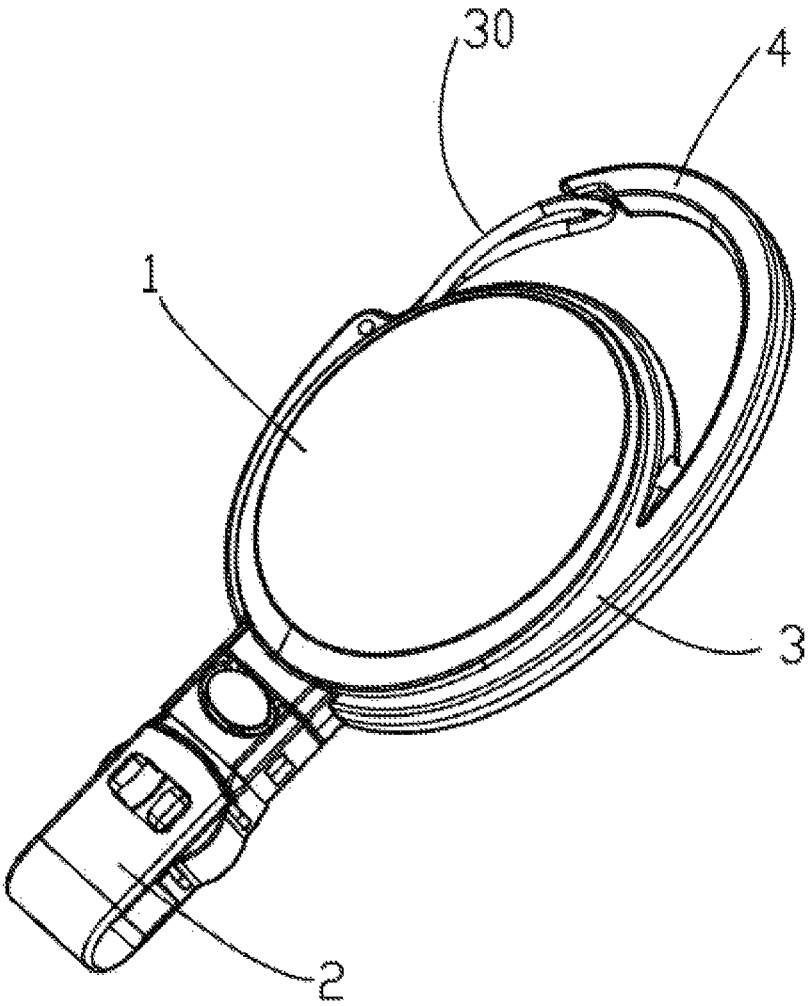
FIG. 1 is a schematic view of a buckle belt assembly in accordance with one embodiment of the present disclosure.

In order to explain the technical solution of the present disclosure more clearly and completely, the present disclosure will be further described in accompanying with the drawings.

Referring to FIGS. 1-7, the present disclosure relates to a buckle belt assembly. The buckle belt assembly includes a main body 1 and a buckle belt 2. The main body 1 includes an upper shell 10, a lower shell 11, an accommodating cavity 12 being formed by fastening the upper shell 10 with the lower shell 11, a restoring device 13 being configured within the accommodating cavity 12, a cable 14 being winded on the restoring device 13 and having one end being fixed to the restoring device 13, and a receiving groove 15 communicating with the accommodating cavity 12. The receiving groove 15 is formed by simultaneously extending the upper shell 10 and the lower shell 11 outwardly. The other end of the cable 14 is fixed to the buckle belt 2. The buckle belt 2 includes an insertion end 200 and a first movable portion 201. The buckle belt 2 may be fixed to or detached from the main body 1 by pressing the first movable portion 201. When the restoring device 13 drives the cable 14 to unfold, the buckle belt 2 may detach from the main body 1. When the restoring device 13 drives the cable 14 to restore, the buckle belt 2 may approach the main body 1, and the insertion end 200 may automatically insert into the receiving groove 15.

The restoring device 13 may include a shaft wheel 130 and a winder 131 being configured in the shaft wheel 130. The cable 14 is wound around the shaft wheel 130.

In one example, the restoring device 13 may include the shaft wheel 130 and the winder 131 being configured in the shaft wheel 130. The cable 14 is wound around the shaft wheel 130. When the cable 14 is unfolded relative to the shift wheel 130, the winder 131 is configured to generate a restoring force to drive the restoring device 13 to automatically restore the cable 14. The buckle belt 2 is configured to hang the hanging objects, such as keys and badges. When the buckle belt 2 is configured to hang an object, weights of the objects may pull the cable 14 through the accommodating cavity 12 and the receiving groove 15 in sequence. That is, the buckle belt 2 is suspended relative to the main body 1. When there is no any hanging object on being hang on the buckle belt 2, the restoring device 13 is configured to automatically restore the cable 14. The buckle belt 2 may approach to the main body 1 until a portion of the insertion end 200 automatically insert into the receiving groove 15. Users may press the insertion end 200 to completely insert the insertion end 200 into the receiving groove 15 by hands. The insertion end 200 and the receiving groove 15 are engaged to fix the buckle belt 2 onto the main body 1. As such, even when a heavy hanging object, such as a keychain, is hang on the buckle belt 2, the buckle belt assembly of the present disclosure may be able to withstand.

Positioning of the main body 1 and the buckle belt 2 of the conventional buckle belt assembly may be inaccurate when the cable 14 is restored, and the main body 1 may not be fixed to the buckle belt 2. The buckle belt assembly of the present disclosure is able to automatically position the buckle belt 2 and an outer shell of the buckle belt assembly when the cable 14 is restored via a configuration of the receiving groove 15 cooperating with the insertion end 200. When a load carried by the buckle belt assembly is required to be heavy, the insertion end 200 may be fixed in the receiving groove 15, and the buckle belt 2 may be fixed to the main body 1. Such that load-carrying capability of the buckle belt assembly of the present disclosure may be great.

In one example, when the first movable portion 201 is pressed to disengage the insertion portion 200 from the receiving groove 15, the cable 14 may be pulled out, and the cable 14 and the buckle belt 2 may be used. A cross section of the receiving groove 15 may be rectangular. The upper shell 10 may include a first holding wall 100, and the lower shell 11 may include a second holding wall 111. The first holding wall 100 perpendicularly abuts the second holding wall 111 to form the receiving groove 15.

The buckle belt 2 may further include a first body 20 and a second body 21 being sleeved on the first body 21. The insertion end 200 and the first movable portion 201 are configured on the first body 20. An arc-shaped gap 202 is configured between the first movable portion 201 and the first body 20.

In one example, the buckle belt 2 may be a plastic element. The first body 20 and the second body 21 may be integrally formed, so as to improve assembly efficiency of the buckle belt 2, and to facilitate an industrialized manufacturing process of the first body 20, the second body 21, and the buckle body 2, and to improve production efficiency. The first movable portion 201 may be flexibly moved relative to the first body 20 by a configuration of the arc-shaped gap 202.

The receiving groove 15 is recessed inwardly to form a first positioning slot 150. The first body 20 may further include a positioning block 203. When the insertion end 200 is completely inserted into the receiving groove 15, the positioning block 203 is engaged with the first positioning slot 150 to fix the buckle belt 2 and the main body 1.

The first movable portion 201 may be manually driven to disengage the positioning block 203 from the first positioning slot 150. The buckle belt 2 may be manually pulled to separate the buckle belt 2 from the main body 1. The restoring device 13 is configured to unfold the cable 14.

In one example, when the insertion end 200 is completely inserted into the receiving groove 15, the positioning block 203 may engage with the first positioning slot 150 to fix the buckle belt 2 and the main body 1. When the insertion end 200 is not completely inserted into the receiving groove 15, the positioning block 203 may not engage with the first positioning slot 150, and the buckle belt 2 and the main body 1 may not be fixed. The buckle belt 2 may be pulled out from the main body 1 without pressing the first movable portion 201. The positioning between the buckle belt 2 and the main body 1 may become accurate and fast by a configuration of the first positioning slot 150, the positioning block 203, and the receiving groove 15 being cooperating with the insertion end 200. As such, a fixing force between the buckle belt 2 and the main body 1 may be increased, and the load-carrying capability of the buckle belt assembly may be improved.

The second body 21 may include a hook 210 and a fixing block 211. The fixing block 211 is perpendicular to the hook 210. The first body 20 may further include a hooking hole 204. The hook 210 may be engaged with the hooking hole 204 to fix the first body 20 to the second body 21. The fixing block 211 is configured to increase the fixing force between the first body 20 and the second body 21.

In one example, the second body 21 may include two hooks 210. The first body 20 may also include two hooking holes 204 correspondingly. One hook 210 may be cooperative with one hooking hole 204. The first body 20 and the second body 21 may quickly be positioned, installed, and fixed via the hook 210. As such, operation process of the buckle belt assembly may be simplified.

The second body 21 may further include a supporting portion 212, a second movable portion 213, and a band 216 extending from a bottom of the supporting portion 212. One end of the second movable portion 213 is connected to the supporting portion 212, and the other end of the second movable portion 213 is movable relative to the supporting portion 212.

The second movable portion 213 may further include a pair of side walls 213*a* and a pair of fixing walls 213*b*. The band 216 may be a flexible and bendable plastic element. The band 216 is configured to hang the hanging objects. The band 216 is configured with a fixing hole 2160. The side walls 213*a* may be pressed to abut the fixing wall 213*b* to the fixing hole 2160 or to detach the fixing wall 213*b* from the fixing hole 2160, thereby opening or closing the band 216.

Each of the side walls 213*a* may further include a first gap 214 with respect to the supporting portion 212. Each of the fixing walls 213*b* may further include a second gap 215 with respect to the supporting portion 215. The first gap 214 is connected to the second gap 215.

In one example, the side walls 213*a* moves along with the fixing walls 213*b*. The side walls 213*a* and the fixing walls 213*b* are flexible. The pair of the fixing walls 213*b* may approach to each other when the side walls 213*a* are pressed. The pair of the fixing walls 213*b* may be separated from each other when the side walls 213*a* are released and are separated from each other. The first gap 214 may be rectangular, and the second gap 215 may be arc-shaped. The side walls 213*a* and the fixing walls 213*b* may have a moving space by a configuration of the first gap 214 and the second gap 215, which facilitates to mold.

In one example, a diameter of the fixing hole 2160 is just enough to allow one end of the fixing wall 213*b* to pass through when the fixing walls 213*b* approach to each other. When pressing force is removed, the fixing walls 213*b* may be expanded within the fixing hole 2160, and the fixing walls 213*b* may abut to the fixing hole 2160 to fix the band 216 to the second movable portion 213. Such that the hanging objects being hang onto the band 216 may be prevented from being lost during use. A pressing hook of the conventional buckle belt assembly may become unstable due to being worn out and the increasing number of use. The buckle belt assembly of the present disclosure may be stabilized by a cooperation of the fixing hole 2160 and the second movable portion 213. As such, abrasion may be avoided, life cycle may be extended, and the operation process of the buckle belt assembly may be simplified.

In one example, the band 216 has certain elasticity and toughness, and may generate a certain restoring force. When the side walls 213*a* are pressed, the fixing walls 213*b* may detach from the fixing hole 2160, such that the band 216 may be opened automatically. A surface of the band 216 is flat and has no any protrudes, which is facilitate to the small-sized hanging objects to pass through the band 216.

In one example, the buckle belt assembly may further include a first holding portion 3 and a second holding portion 4. The first holding portion 3 is sleeved on the main body 1. The second holding portion 4 is arc-shaped and protrudes from the first holding portion 3. The first holding portion 3 may include a pressing hook 30 being movable relative to the second holding portion 4. One end of the pressing hook 30 may abut to or detach from the second holding portion 4 when the pressing hook 30 is pressed.

Figure 7:
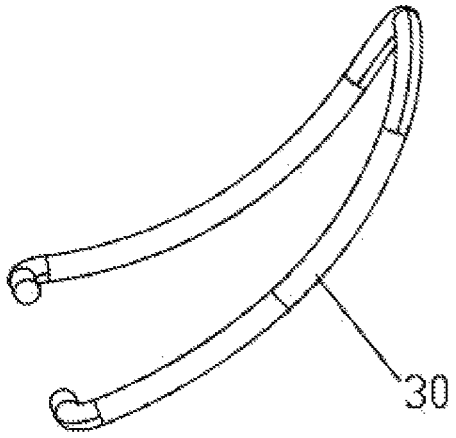
FIG. 7 is a schematic view of the buckle belt assembly in accordance with one embodiment of the present disclosure.

In one example, the first holding portion 3 and the second holding portion 4 are configured to be easily carried. The first holding portion 3 is sleeved on the main body 1. The receiving groove 15 protrudes from the first holding portion 3. That is, the main body 1 is half-wrapped by the first holding portion 3. Referring to FIG. 7, the pressing hook 30 is configured to be at an angle within a range between 10 degrees to 20 degrees. The pressing hook 30 is configured to generate the restoring force automatically without a configuration of an additional elastic element. The pressing hook 30 may be fixed on the first holding portion 3. The buckle belt assembly may easily be fixed externally by the pressing hook 30.

Figure 2:
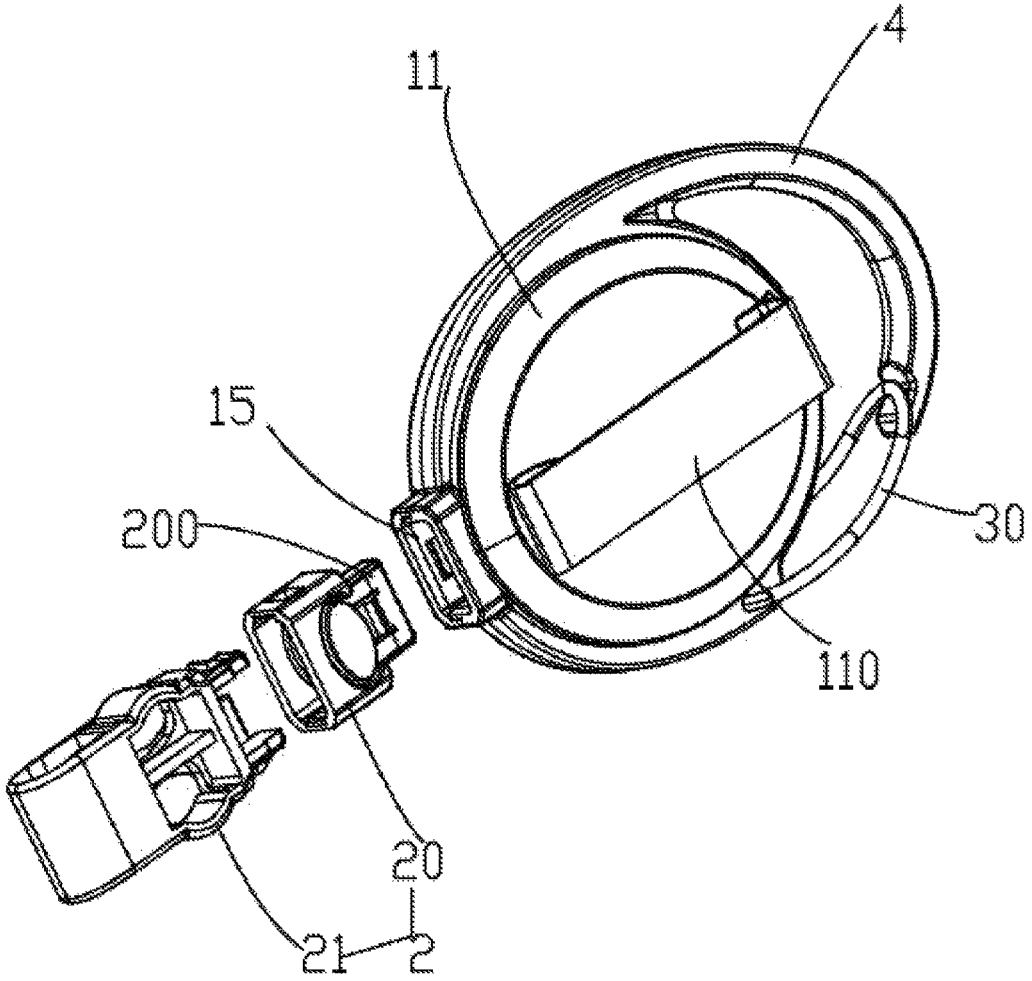
FIGS. 2 to 3 are schematic views of the buckle belt assembly in accordance with one embodiment of the present disclosure.
Figure 3:
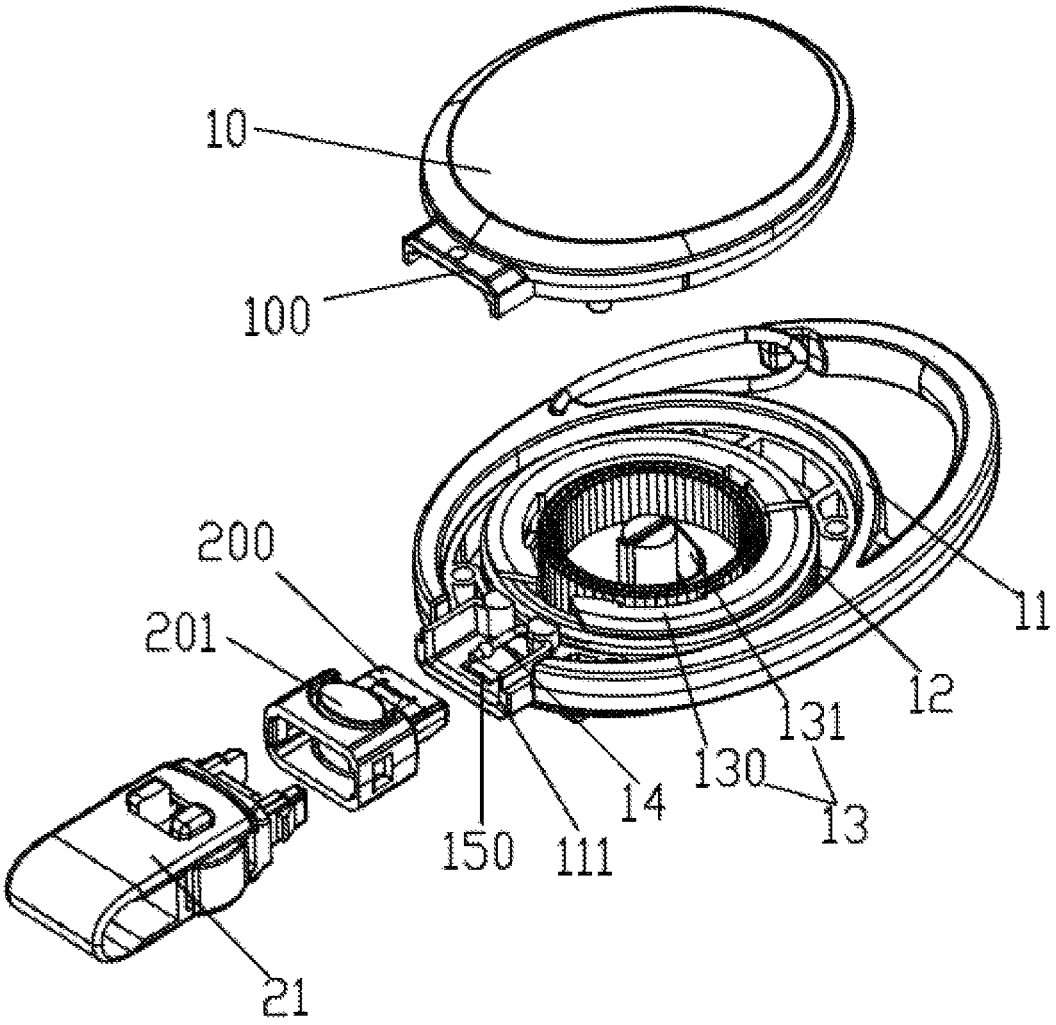
Figure 4:
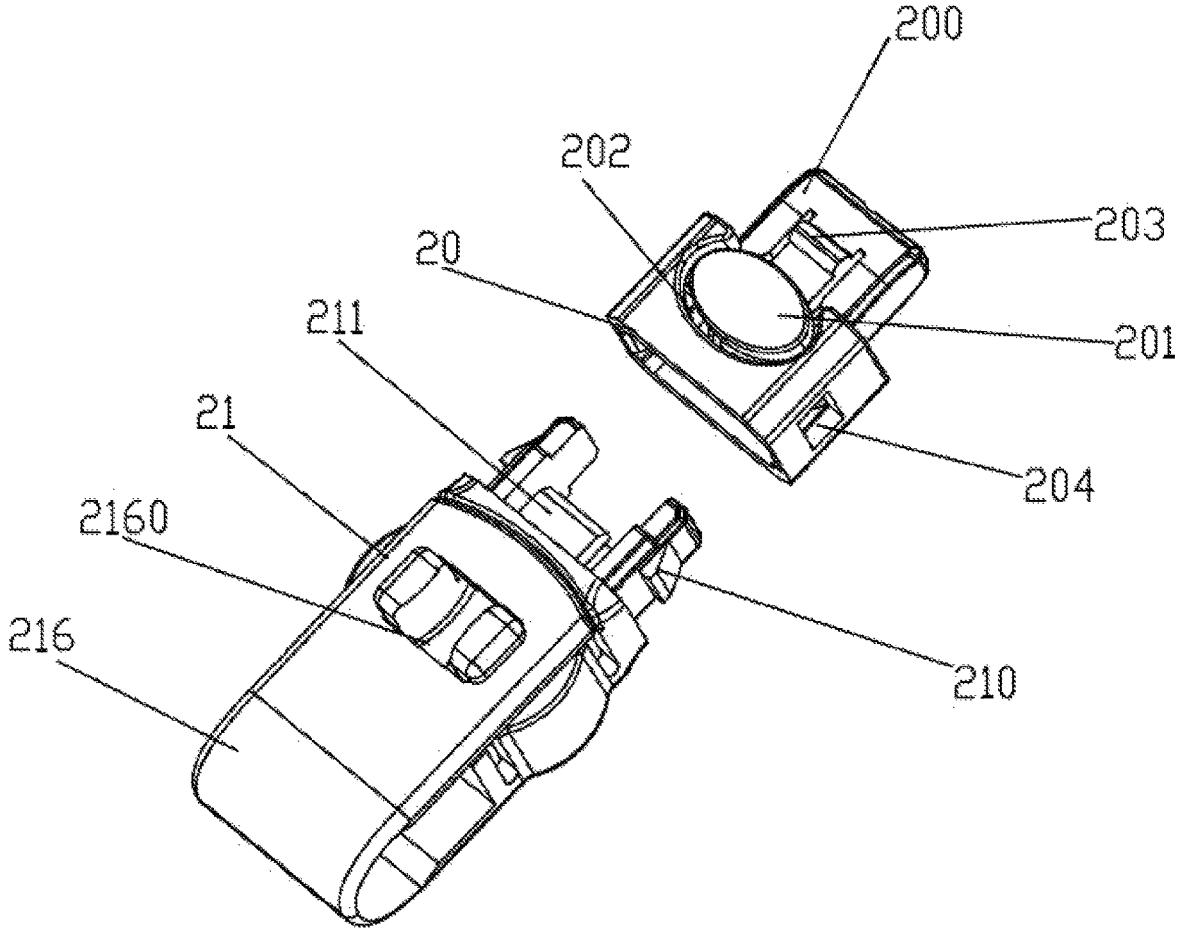
FIG. 4 is a schematic view of the buckle belt assembly in accordance with one embodiment of the present disclosure.
Figure 5:
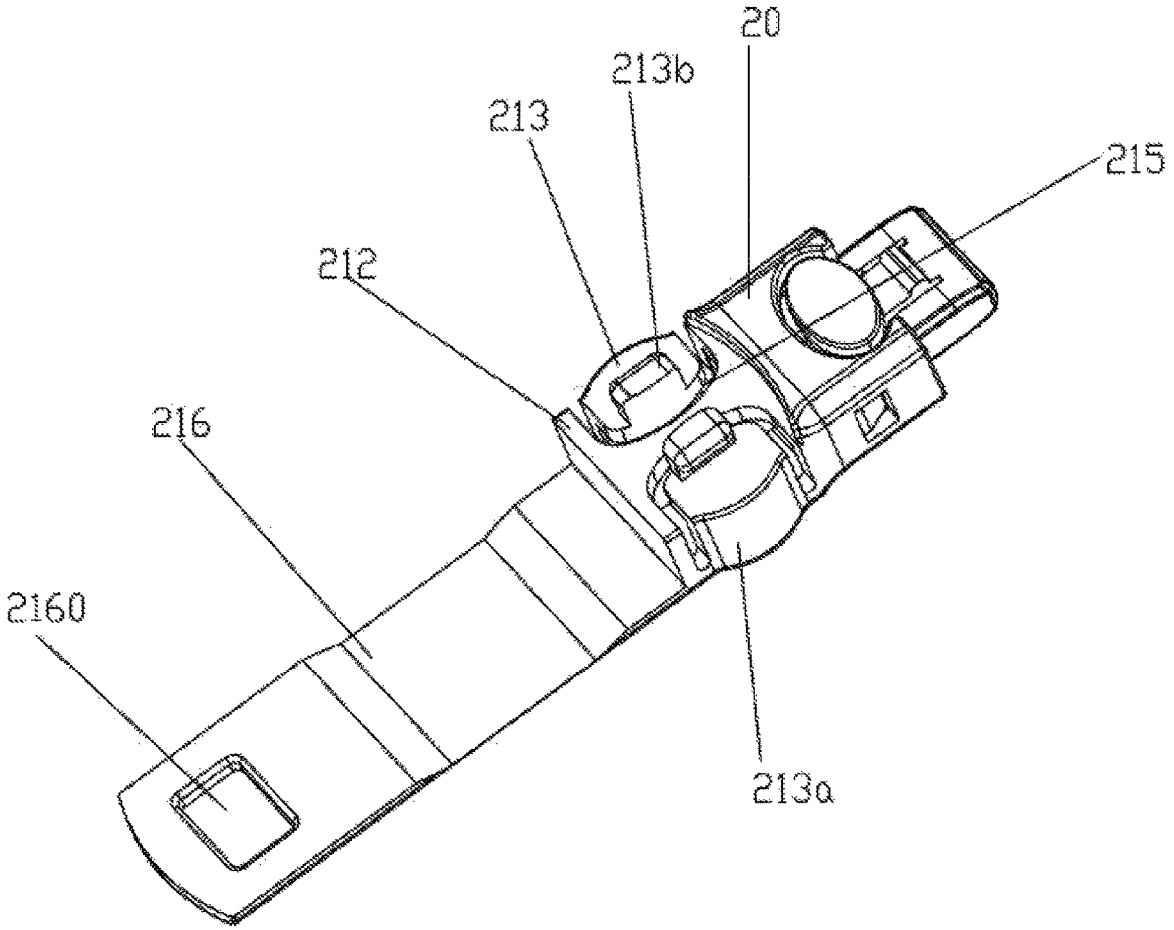
FIGS. 5 to 6 are schematic views of the buckle belt assembly in accordance with one embodiment of the present disclosure.
Figure 6:
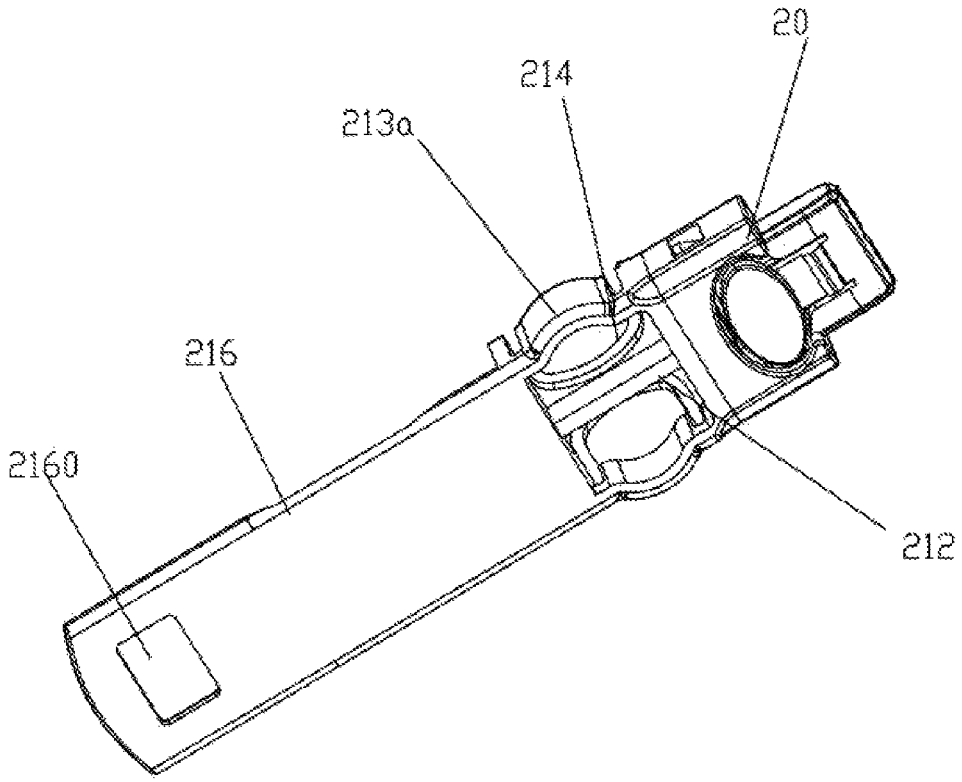
Figure 8:
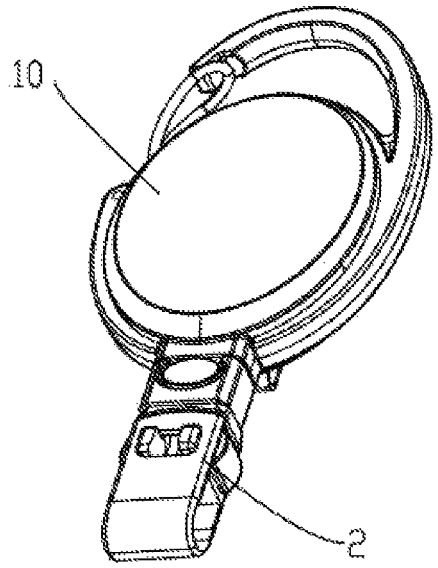
FIGS. 8 to 9 are schematic views of an upper shell of the buckle belt assembly in accordance with one embodiment of the present disclosure.
Figure 9:
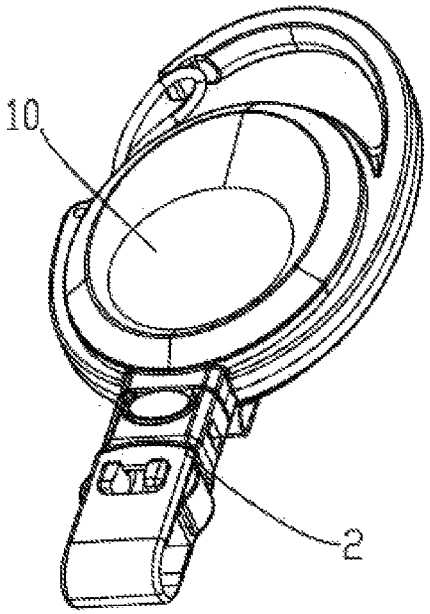

Referring to FIG. 2, FIG. 8 and FIG. 9, the lower shell 11 may include a flexible fixing sheet 110. The elastic fixing sheet 110 is configured to fix the buckle belt assembly externally. An end surface of the upper shell 10 may be a flat surface, an oblique concave surface, or a sloped surface.

In one example, the flexible fixing sheet 110 is configured to fix the buckle belt assembly externally. The end surface of the upper shell 10 and an end surface of the lower shell 11 may be the flat surface, the oblique concave surface, or the sloped surface. Graphic designs may be disposed on the flat surface, the oblique concave surface, or the sloped surface to increase varieties of products, and consumers may select the product according to personal preference.

Figure 10:
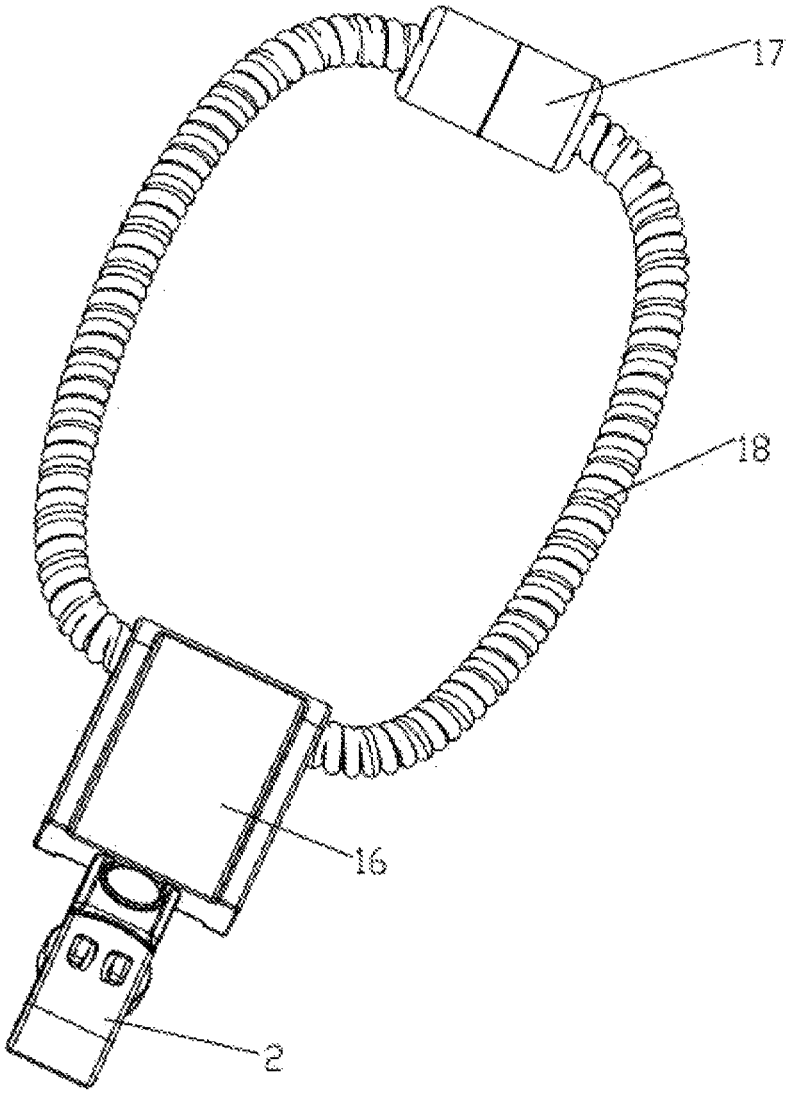
FIG. 10 is a schematic view of the buckle belt assembly in accordance with another embodiment of the present disclosure.
Figure 11:
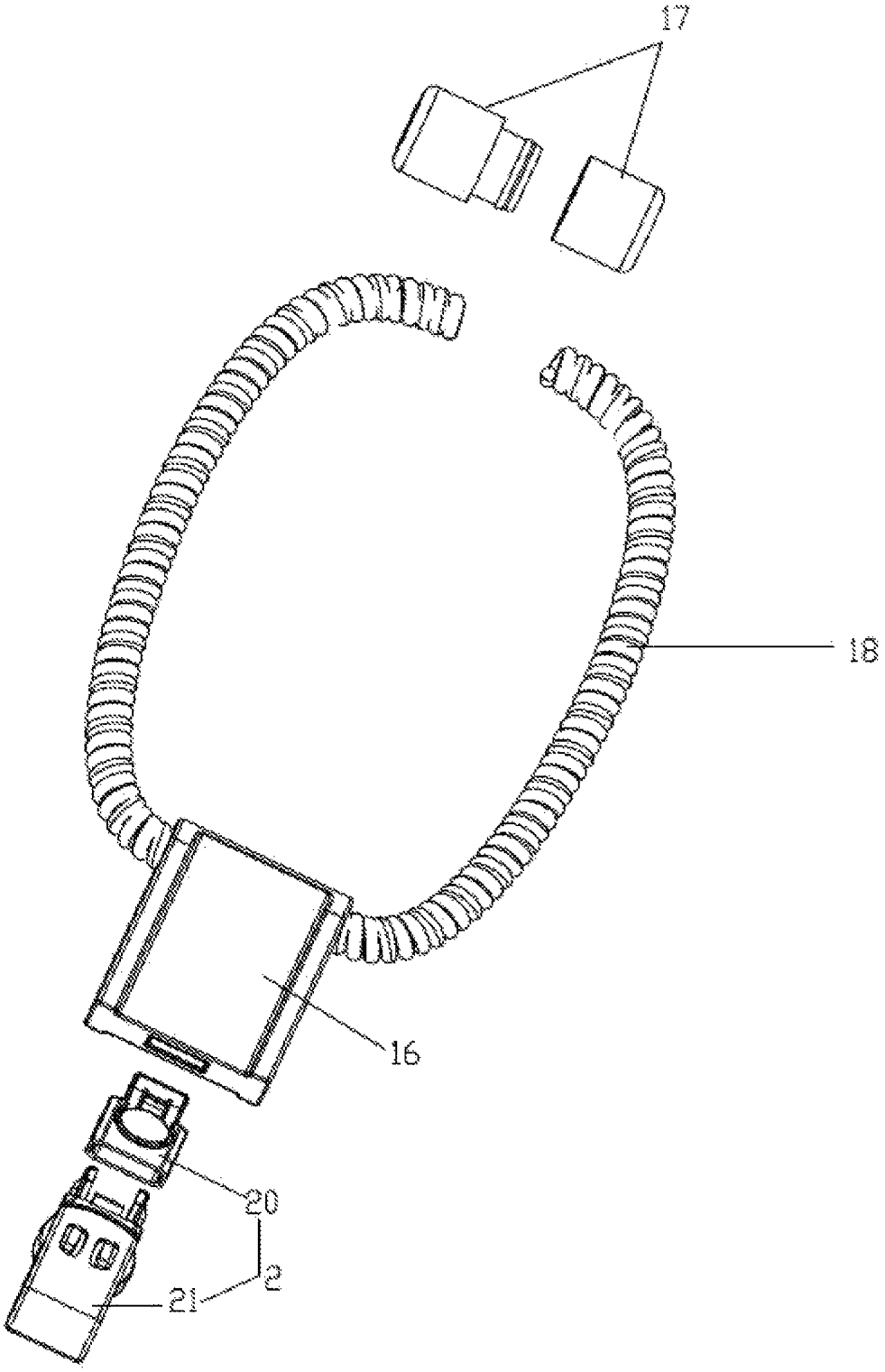
FIG. 11 is a schematic view of the buckle belt assembly in accordance with another embodiment of the present disclosure.

In one example, referring to FIG. 10 and FIG. 11, a structure of the buckle belt assembly is similar to the buckle belt assembly described above. The main body 1 of the buckle belt assembly may further include a first connecting portion 16, a second connecting portion 17, and a hanging rope 18. The insertion end 200 is configured to insert into the first connecting portion 16. The hanging rope 18 is configured to penetrate through the first connecting portion 16. The second connecting portion 17 is configured to connect two ends of the hanging rope 18. The first connecting portion 16 may be a block. The hanging rope 18 may be a flexible soft rope, or may be other ropes having a circular cross section. The second connecting portion 17 may include a first connecting end and a second connecting end. The first connecting end and the second connecting end respectively connect to the two ends of the hanging rope 18. The first connecting end and the second connecting end may be fastened to connect the two ends of the hanging rope 18.

Above are embodiments of the present invention, which does not limit the scope of the present invention. Any equivalent amendments within the spirit and principles of the embodiment described above should be covered by the protected scope of the invention.

What is claimed is:

1. A buckle belt assembly, comprising:

a main body; and a buckle belt, comprising a first body and a second body being sleeved on the first body;

wherein the second body further comprises a supporting portion, a second movable portion, and a band being extending from a bottom of the supporting portion, one end of the second movable portion connects to the supporting portion, and the other end of the second movable portion is movable relative to the supporting portion;

the second movable portion further comprises a pair of side walls and a pair of fixing walls, the band is configured with a fixing hole, and the fixing walls engage with the fixing hole or detached from the fixing hole when the side walls are pressed;

each of the side walls comprises a first gap with respect to the supporting portion, each of the fixing walls comprises a second gap with respect to the supporting portion, and the first gap communicates with the second gap;

the second body comprises a hook and a fixing block, and the fixing block is perpendicular to the hook; and the first body further comprises a hooking hole configured to be engaged with the hook to fix the first body to the second body, and the fixing block is configured to increase a fixing force between the first body and the second body.

2. The buckle belt assembly according to claim 1, wherein the buckle belt comprises an insertion end and a first movable portion, the buckle belt is configured to be fixed to or detached from the main body when the first movable portion is moved, the insertion end and the first movable portion are configured on the first body, an arc-shaped gap is connected between the first movable portion and the first body, and the first body further comprises a positioning block.

3. The buckle belt assembly according to claim 2, wherein the main body comprises:

an upper shell;

a lower shell;

an accommodating cavity being formed by fastening the upper shell with the lower shell;

a restoring device being configured within the accommodating cavity;

a cable being winded on the restoring device, wherein one end of the cable is fixed to the restoring device, and the other end of the cable is fixed to the buckle belt;

wherein the restoring device comprises a shaft wheel and a winder being configured in the shaft wheel, the cable is wound around the shaft wheel, a receiving groove is formed by simultaneously extending the upper shell and the lower shell outwardly, and the receiving groove communicates with the accommodating cavity;

when the buckle belt is manually pulled to unfold the cable, the buckle belt detaches from the main body;

when a pulling force is removed, the restoring device is configured to restore the cable, the buckle belt approaches the main body, and the insertion end automatically inserts into the receiving groove.

4. The buckle belt assembly according to claim 3, wherein the receiving groove is recessed inwardly to form a first positioning slot, when the insertion end is completely inserted into the receiving groove, the positioning block is engaged with the first positioning slot to fix the buckle belt to the main body.

5. The buckle belt assembly according to claim 4, wherein the first movable portion is manually driven to disengage the positioning block from the first positioning slot, the buckle belt is manually pulled to separate the buckle belt from the main body, and the restoring device is configured to unfold the cable.

6. The buckle belt assembly according to claim 2, wherein the main body comprises a first connecting portion, a second connecting portion, and a hanging rope;

the insertion end is configured to be inserted into the first connecting portion, the hanging rope is configured to penetrate through the first connecting portion, and the second connecting portion is configured to connect two ends of the hanging rope.

7. The buckle belt assembly according to claim 3, wherein the lower shell comprises a flexible fixing sheet being configured to fix the buckle belt assembly externally, and an end surface of the upper shell and an end surface of the lower shell are configured to be a flat surface, an oblique concave surface, or a sloped surface.

8. The buckle belt assembly according to claim 1, wherein the buckle belt assembly further comprises:

a first holding portion being sleeved on the main body; and a second holding portion being arc-shaped and being protruding from the first holding portion;

the first holding portion comprises a pressing hook being movable relative to the second holding portion, and one end of the pressing hook is configured to abut to or detach from the second holding portion when the pressing hook is pressed.

9. A buckle belt assembly, comprising:

a main body; and a buckle belt, comprising a first body and a second body being sleeved on the first body;

wherein the second body further comprises a supporting portion, a second movable portion, and a band being extending from a bottom of the supporting portion, one end of the second movable portion connects to the supporting portion, and the other end of the second movable portion is movable relative to the supporting portion;

the second movable portion further comprises two side walls facing to each other and two fixing walls arranged oppositely to the side walls, the band is configured with a fixing hole, and the fixing walls engage with the fixing hole or detached from the fixing hole when the side walls are pressed.

10. The buckle belt assembly according to claim 9, wherein each of the side walls comprises a first gap with respect to the supporting portion, each of the fixing walls comprises a second gap with respect to the supporting portion, and the first gap communicates with the second gap.

11. The buckle belt assembly according to claim 9, wherein the second body comprises a hook and a fixing block, and the fixing block is perpendicular to the hook; and the first body further comprises a hooking hole configured to be engaged with the hook to fix the first body to the second body, and the fixing block is configured to increase a fixing force between the first body and the second body.

12. The buckle belt assembly according to claim 9, wherein the buckle belt comprises an insertion end and a first movable portion, the buckle belt is configured to be fixed to or detached from the main body when the first movable portion is moved, the insertion end and the first movable portion are configured on the first body, an arc-shaped gap is connected between the first movable portion and the first body, and the first body further comprises a positioning block.

13. The buckle belt assembly according to claim 12, wherein the main body comprises:

an upper shell;

a lower shell;

an accommodating cavity being formed by fastening the upper shell with the lower shell;

a restoring device being configured within the accommodating cavity;

a cable being winded on the restoring device, wherein one end of the cable is fixed to the restoring device, and the other end of the cable is fixed to the buckle belt;

wherein the restoring device comprises a shaft wheel and a winder being configured in the shaft wheel, the cable is wound around the shaft wheel, a receiving groove is formed by simultaneously extending the upper shell and the lower shell outwardly, and the receiving groove communicates with the accommodating cavity;

when the buckle belt is manually pulled to unfold the cable, the buckle belt detaches from the main body;

when a pulling force is removed, the restoring device is configured to restore the cable, the buckle belt approaches the main body, and the insertion end automatically inserts into the receiving groove.

14. The buckle belt assembly according to claim 13, wherein the receiving groove is recessed inwardly to form a first positioning slot, when the insertion end is completely inserted into the receiving groove, the positioning block is engaged with the first positioning slot to fix the buckle belt to the main body.

15. The buckle belt assembly according to claim 14, wherein the first movable portion is manually driven to disengage the positioning block from the first positioning slot, the buckle belt is manually pulled to separate the buckle belt from the main body, and the restoring device is configured to unfold the cable.

16. The buckle belt assembly according to claim 12, wherein the main body comprises a first connecting portion, a second connecting portion, and a hanging rope;

the insertion end is configured to be inserted into the first connecting portion, the hanging rope is configured to penetrate through the first connecting portion, and the second connecting portion is configured to connect two ends of the hanging rope.

17. The buckle belt assembly according to claim 13, wherein the lower shell comprises a flexible fixing sheet being configured to fix the buckle belt assembly externally, and an end surface of the upper shell and an end surface of the lower shell are configured to be a flat surface, an oblique concave surface, or a sloped surface.

18. The buckle belt assembly according to claim 9, wherein the buckle belt assembly further comprises:

a first holding portion being sleeved on the main body; and a second holding portion being arc-shaped and being protruding from the first holding portion;

the first holding portion comprises a pressing hook being movable relative to the second holding portion, and one end of the pressing hook is configured to abut to or detach from the second holding portion when the pressing hook is pressed.

19. The buckle belt assembly according to claim 9, wherein the two fixing walls approach to each other when the two side walls are pressed to approach to each other.

20. A buckle belt assembly, comprising:

a main body; and a buckle belt, comprising a first body and a second body being detachably sleeved on the first body;

wherein the second body further comprises a supporting portion, a second movable portion, and a band being extending from a bottom of the supporting portion, one end of the second movable portion connects to the supporting portion, and the other end of the second movable portion is movable relative to the supporting portion; and the second movable portion further comprises a pair of side walls and a pair of fixing walls, the band is configured with a fixing hole, and the fixing walls engage with the fixing hole or detached from the fixing hole when the side walls are pressed.

* * * * *